US008038418B2

(12) United States Patent
Hell et al.

(10) Patent No.: US 8,038,418 B2
(45) **Date of Patent: *Oct. 18, 2011**

(54) LINEAR COMPRESSOR

(75) Inventors: Erich Hell, Giengen (DE); Jan-Grigor Schubert, Senden (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 947 days.

This patent is subject to a terminal disclaimer.

(21) Appl. No.: 11/794,041

(22) PCT Filed: Nov. 29, 2005

(86) PCT No.: PCT/EP2005/056304

§ 371 (c)(1),
(2), (4) Date: Jan. 15, 2008

(87) PCT Pub. No.: WO2006/069875

PCT Pub. Date: Jul. 6, 2006

(65) Prior Publication Data

US 2008/0267797 A1 Oct. 30, 2008

(30) Foreign Application Priority Data

Dec. 23, 2004 (DE) ..... 10 2004 062 307

(51) Int. Cl.
*F04B 35/00* (2006.01)

(52) U.S. Cl. ..... 417/363; 417/417

(58) Field of Classification Search ..... 417/363, 417/415–417

See application file for complete search history.

(56) References Cited

U.S. PATENT DOCUMENTS

| | | | | |
|---|---|---|---|---|
| 1,996,160 | A | 4/1935 | König | |
| 2,315,222 | A | 3/1943 | Lawrence | |
| 2,907,304 | A | 10/1959 | Macks | |
| 3,538,357 | A * | 11/1970 | Barthalon | 310/16 |
| 4,634,297 | A | 1/1987 | Schriwer | |
| 4,966,789 | A | 10/1990 | Knapp et al. | |
| 4,974,498 | A | 12/1990 | Lemelson | |
| 5,140,905 | A | 8/1992 | Dhar | |

(Continued)

FOREIGN PATENT DOCUMENTS

AT 007 706 U 7/2005

(Continued)

OTHER PUBLICATIONS

International Search Report PCT/EP2005/056304.

*Primary Examiner* — Charles Freay
(74) *Attorney, Agent, or Firm* — James E. Howard; Andre Pallapies

(57) ABSTRACT

A linear compressor has a rigid frame (11, 12, 13), on which an oscillating body (16) is held via at least one spring (9) so as to be able to effect reciprocating motion and at least one electromagnet (14, 15) is mounted for driving the reciprocating motion of the oscillating body (16), and having a pump chamber (13) forming part of the frame, in which pump chamber a piston, connected to the oscillating body (16), may effect reciprocating motion. The frame (11, 12, 13) is connected in an oscillatory manner to a fixing member (1) for fixing the linear compressor to a support by a diaphragm spring (5, 7, 9) oriented transversely of the direction of movement of the oscillating body.

28 Claims, 3 Drawing Sheets

U.S. PATENT DOCUMENTS

| | | | | |
|---|---|---|---|---|
| 5,186,137 | A | 2/1993 | Salzmann | |
| 5,255,521 | A | 10/1993 | Watanabe | |
| 5,318,412 | A | 6/1994 | Laskaris et al. | |
| 5,525,845 | A | 6/1996 | Beale et al. | |
| 5,772,410 | A | 6/1998 | Chang | |
| 5,779,455 | A | 7/1998 | Steiger | |
| 6,073,648 | A | 6/2000 | Watson et al. | |
| 6,506,032 | B2 | 1/2003 | Kawahara et al. | |
| 6,641,377 | B2 | 11/2003 | Toyama et al. | |
| 6,742,998 | B2 * | 6/2004 | Kawahara et al. | 417/416 |
| 6,832,899 | B2 * | 12/2004 | Puff et al. | 417/363 |
| 7,896,623 | B2 * | 3/2011 | Hell et al. | 417/363 |
| 2002/0155012 | A1 | 10/2002 | Zabar | |
| 2005/0144967 | A1 | 7/2005 | Hebestreit et al. | |
| 2005/0244290 | A1 | 11/2005 | Inagaki et al. | |
| 2006/0083628 | A1 | 4/2006 | Kanai et al. | |

FOREIGN PATENT DOCUMENTS

| | | |
|---|---|---|
| DE | 81 32 123 U | 4/1985 |
| DE | 198 02 453 | 8/1999 |
| EP | 0 864 750 | 9/1998 |
| EP | 0 909 895 | 4/1999 |
| EP | 1 045 145 | 10/2000 |
| EP | 1 126 171 | 8/2001 |
| EP | 1 450 042 | 8/2004 |
| FR | 743.398 | 3/1933 |
| GB | 1 222 425 | 2/1971 |
| JP | 2002-349435 | 12/2002 |
| JP | 2003-49943 | 2/2003 |
| JP | 2004-361039 | 12/2004 |
| WO | WO 89/03480 | 4/1989 |
| WO | WO 00/70223 | 11/2000 |
| WO | WO 03/081041 | 10/2003 |

* cited by examiner

LINEAR COMPRESSOR

The present invention relates to a linear compressor, in particular a linear compressor which is suitable for compressing refrigerants in a refrigerator.

BACKGROUND OF THE INVENTION

U.S. Pat. No. 6,641,377 B2 discloses a linear compressor having a pump chamber, in which a piston may effect reciprocating motion, a frame connected firmly to the pump chamber, on which frame an oscillating body connected to the piston is held via at least one spring so as to be able to effect reciprocating motion, and at least one electromagnet mounted on the frame for driving the reciprocating motion of the oscillating body.

The oscillatory force exerted by the magnet on the oscillating body brings about a corresponding oscillatory counterforce, which the frame exerts on a mount to which it is fixed. If not compensated, this oscillatory counterforce may cause the mount or other components connected thereto to oscillate, which will be perceived by a user as operating noise.

To keep such oscillations small, in the known linear compressor two pistons work together, penetrating into the pump chamber from two different sides. If these pistons have identical masses and are supported by springs of identical strength, it is possible to control the driving electromagnet of each piston in such a way that the pistons oscillate exactly in phase opposition, such that the counterforces caused by the oscillatory motion and acting on the frame compensate one another.

Such a linear compressor is complex, since the pistons and the drive means associated therewith have in each case to be duplicated. However, it is also difficult to ensure precisely mirror-symmetrical movement of the two pistons, since production-determined variance of the oscillating masses and in particular of the stiffness of the springs supporting them may lead to different natural frequencies of the two pistons. This may, if the magnets are excited with the same alternating current on both sides, result in the piston movement exhibiting different amplitudes and phases.

It is also possible to construct a linear compressor with a single oscillatory piston, in which the transmission of counterforces exerted on a frame to a mount of the compressor is restricted in that the frame is for its part suspended in an oscillatory manner relative to the mount, but such a linear compressor requires a large number of springs, which make assembly of the linear compressor time-consuming and costly.

A further problem with a sprung mount is that most types of spring, if arranged in order to counteract a movement of the frame parallel to the direction of oscillation of the oscillating body, are easily deformable transversely of this direction, such that the frame may be caused to effect rolling movements of considerable amplitude, unless these are suppressed by additional springs providing lateral support or by a rail guide.

SUMMARY OF THE INVENTION

The object of the present invention is to provide a linear compressor which prevents by simple means an excessive transmission of oscillations to a support to which the linear compressor is fixed.

The object is achieved in that the frame is connected in an oscillatory manner to a fixing member, which serves to mount the linear compressor on an external support, via a diaphragm spring oriented transversely of the direction of movement of the oscillating body. Such a diaphragm spring is substantially more easily deformable in the direction of movement of the oscillating body than transversely thereof, such that rolling movements of the compressor transversely of the direction of movement may be effectively suppressed without the need for a transversely rigid connection between the fixing member and the frame.

In order to achieve a precise linear movement of the frame in relation to the fixing member with a small number of components, two opposing end portions of the diaphragm springs are preferably fixed to the fixing member and an intermediate portion is preferably fixed to the frame.

If the centre of gravity of the oscillating body and the centre of gravity of the frame lie on one and the same line extending in the direction of movement of the oscillating body, only counterforces oriented in the direction of movement are induced in the frame by the oscillation of the oscillating body, and no oscillating torques which could trigger a rolling movement of the frame.

In order to restrict the transmission of oscillations not only in the form of structure-borne but also as air-borne noise, the fixing member preferably takes the form of housing surrounding the pump chamber and the frame.

In order to achieve a large stroke despite small diaphragm spring dimensions, said spring preferably comprises at least one curved spring arm. A zigzag-curved spring arm is particularly preferable, since this brings about at most small torques between parts oscillating relative to one another.

In order to keep small torques exerted in conjunction with the oscillation by the diaphragm spring between the frame and the oscillating body, it is additionally convenient for the diaphragm spring to comprise at least two curved arms connecting the frame to the oscillating body and mutually mirror-symmetrical relative to a plane parallel to the direction of movement of the oscillating body. The torques generated by such arms each have opposing directions, such that they compensate one another.

A stable suspension using a minimum number of components may be achieved if the diaphragm spring is a one-piece spring which also includes the spring connecting the oscillating body to the frame.

Such a spring is preferably connected in a middle portion to the oscillating body, in two end portions to the fixing member and at portions located in each case between the middle portion and the end portions to the frame.

In order further to reduce the transmission of oscillations to the support, the spring may be connected to the fixing member via an oscillation-damping element.

In order to ensure precise linear guidance of the oscillating body, the linear compressor is preferably provided with a second one-piece spring, connecting the oscillating body to the frame and the frame to the fixing member, the springs acting on the oscillating body at a distance from one another in the direction of the reciprocating motion.

Drive of the oscillating motion is preferably brought about by at least one pair of magnets arranged antiparallel and with a field axis oriented in the direction of movement of the oscillating body on opposing sides of the oscillating body.

BRIEF DESCRIPTION OF THE DRAWINGS

Further features and advantages of the invention are revealed by the following description of an exemplary embodiment, made with reference to the attached Figures, in which.

DETAILED DESCRIPTION OF THE EXEMPLARY EMBODIMENTS OF THE PRESENT INVENTION

Figure 1:
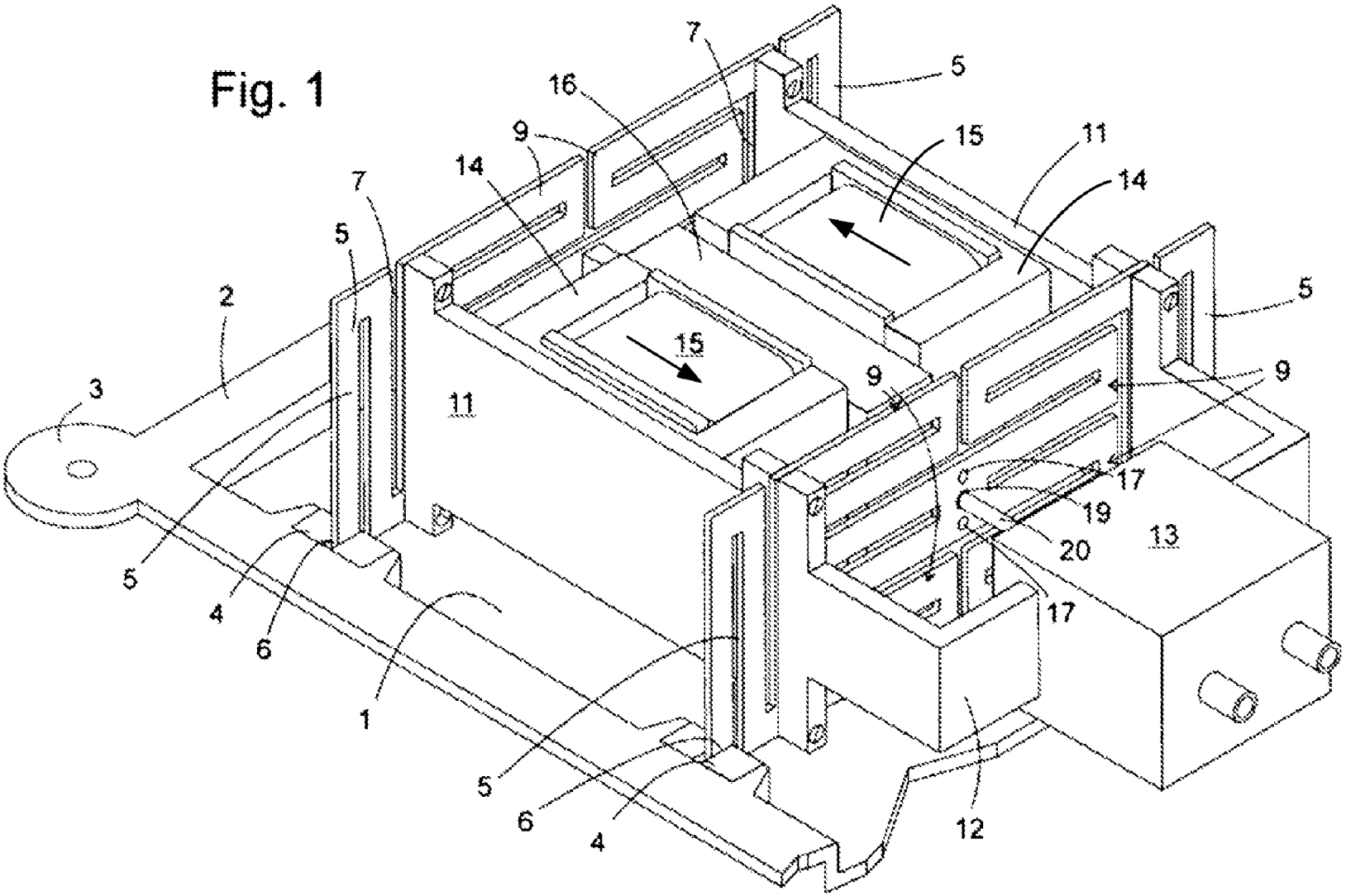
FIG. 1 is a perspective view of a linear compressor according to the invention.

The linear compressor shown in FIG. 1 comprises a sound-insulating housing, of which just one of two shells 1 is illustrated in part in the Figure. The shells meet at a surrounding flange 2 and so form a casing which is continuous except for openings, not shown, for a refrigerant suction line and/or a pressure line. A plurality of eyelets 3 are formed on the flange 2 for fixing the shells to one another and to a support, which is not shown in the Figure and is not regarded as part of the compressor.

Figure 2:
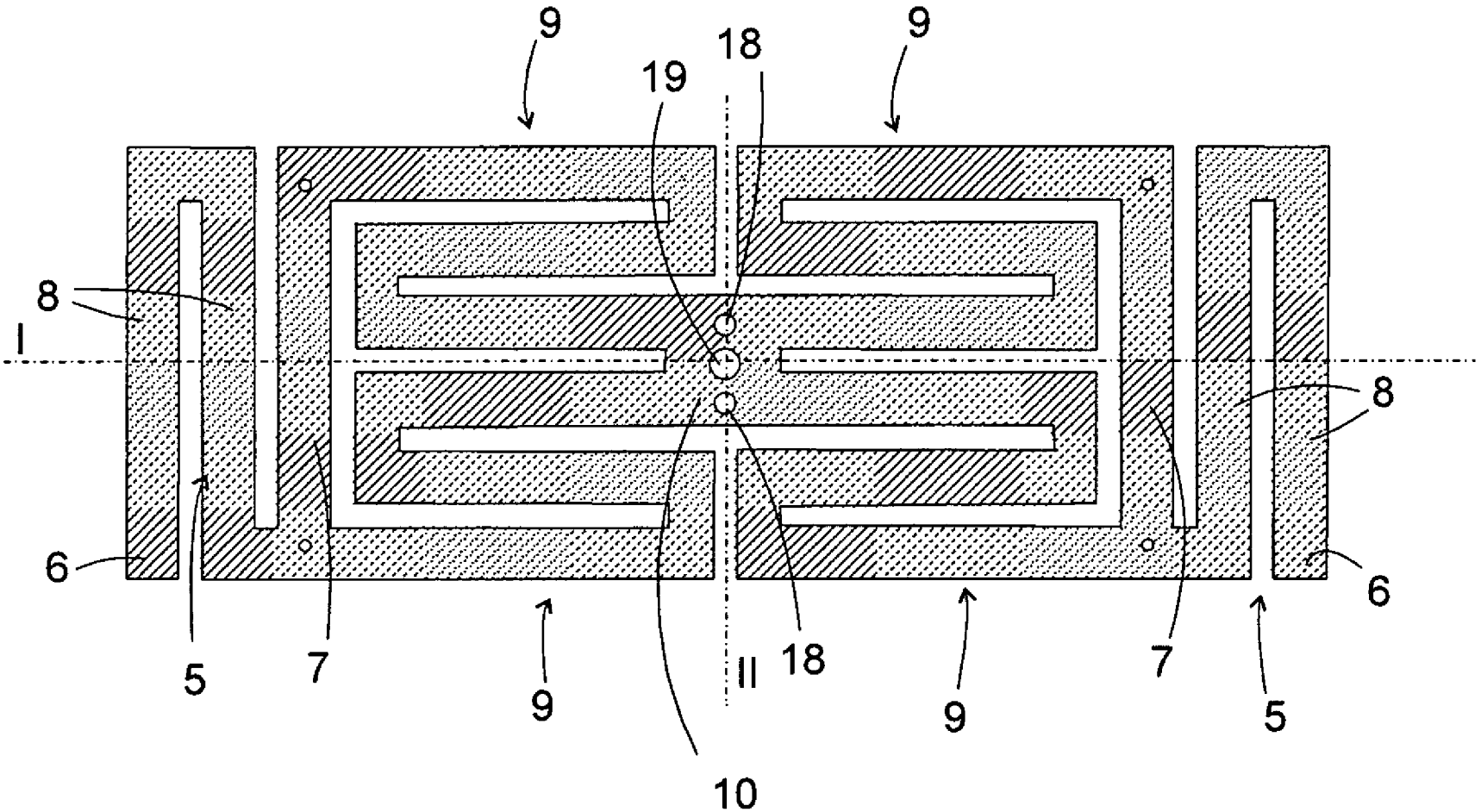
FIG. 2 is a plan view of a diaphragm spring of the linear compressor of FIG. 1.

Four holders for resilient pads 4 of rubber, flexible foam or another oscillation-absorbing material are formed on the inside wall of the shell 1, only two of the four being visible and these being located at an edge of the shell 1 facing the observer. The resilient pads 4 each have a slot, which receives an end portion 6 of a spring arm 5. The spring arms 5 are in each case part of a diaphragm spring stamped out in one piece from spring steel and shown in plan view in FIG. 2.

The diaphragm spring has two spring arms 5, which each extend from an elongated intermediate portion 7 and each comprise two straight portions 8 parallel to the intermediate portion 7. Further spring arms 9 extend from opposing longitudinal ends of the two intermediate portions 7 in a zigzag towards a middle portion 10 of the spring, at which all four spring arms 9 meet. The spring arms 9 each have three straight portions. Each spring arm 9 is the mirror image of the two neighboring spring arms relative to planes of symmetry shown by dash-dotted lines I and II in FIG. 2 and parallel to the direction of oscillation.

Holes at the longitudinal ends of the intermediate portions 7 serve in fixing a frame, which is composed of three elements, two wall pieces 11, which each extend between mutually facing intermediate portions 7 of the two diaphragm springs, and an arch 12, which arches over the spring arms 9 of the front diaphragm spring and in which there is formed a pump chamber 13.

The wall pieces 11 each bear on their mutually facing sides a soft iron core 14 having three interconnected, parallel legs, of which in each case the middle one is concealed in the Figure by a magnet coil 15, through whose winding it extends.

In a gap between the mutually facing free ends of the soft iron cores 14 there is suspended an oscillating body 16. A permanent magnetic middle piece of the oscillating body 16 substantially fills the gap between the soft iron cores 14. Tapered end portions of the oscillating body 16 are in each case held on the diaphragm springs by means of screws or rivets 17, which extend through holes 18 in the middle portion 10 of the diaphragm springs. Through a larger, central hole 19 in the diaphragm spring facing the observer in the Figure there extends a piston rod 20, which connects the oscillating body 16 rigidly to a piston, not shown, capable of reciprocating motion in the pump chamber 13.

The middle portion of the oscillating body 16 is a permanent magnetic bar, whose field axis coincides with the longitudinal axis of the piston rod 20 and whose poles project out of the gap between the soft iron cores 14 in the direction of oscillation in the state of equilibrium shown in FIG. 1. The magnet coils 15 are so wired that their fields each comprise mutually facing poles of the same polarity. By exciting the magnet coils 15 with an alternating current, the north pole or the south pole of the permanent magnet is drawn in each case alternately into the middle of the gap and the oscillating body 16 is thereby caused to oscillate.

The centers of gravity of the frame and the parts connected rigidly thereto on the one hand and of the oscillating body 16 and of the piston on the other hand define a straight line parallel to the direction of oscillation of the oscillating body 16. In this way, it is ensured that the frame performs only reciprocating motion in response to the movement of the oscillating body, and does not perform any rolling movements.

By suspending the oscillating body 16 by means of in each case four spring arms 9 at its two longitudinal ends, the oscillating body 16 may be easily displaced in the direction of the piston rod 20; in a direction perpendicular to this direction the stiffness of the spring arms 9 is considerably greater, such that the oscillating body 16 and with it the piston are reliably guided in the direction of oscillation.

Figure 3:
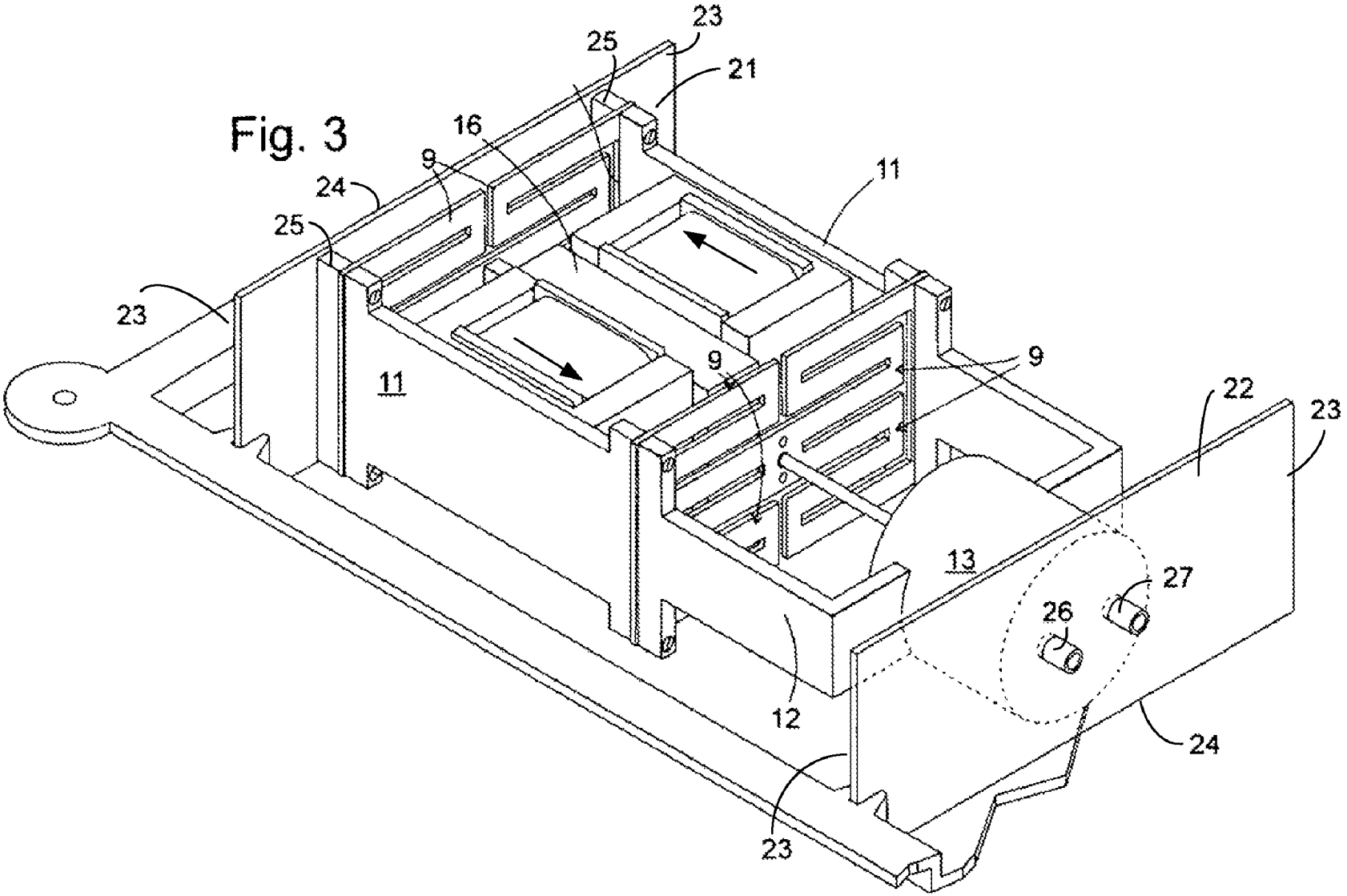
FIG. 3 is a perspective view of a second embodiment of a linear compressor according to the invention.

FIG. 3 shows a modified embodiment of the compressor according to the invention. Parts of the compressor of FIGS. 1 and 2, which recur identically in FIG. 3, are provided with the same reference numerals as in FIG. 1 and are not described again.

The difference between the two embodiments is substantially that, in the embodiment of FIG. 3, the diaphragm springs supporting the oscillating body 16 are not extended beyond the outsides of the wall pieces 11, but instead an oscillatory connection is formed between the frame and the shell 1 of the housing by two additional diaphragm springs 21, 22. Unlike those which support the oscillating body 16, the diaphragm springs 21, 22 are not slotted and are therefore considerably stiffer than the former while exhibiting the same material thickness. Therefore, in the embodiment of FIG. 3 the natural frequency at which the frame oscillates relative to the housing is markedly higher than that of the oscillating body 16, such that the movement thereof cannot efficiently cause the frame to oscillate in relation to the housing.

In the same way as in the embodiment of FIG. 1, the diaphragm springs 21, 22 are inserted into slots in the housing at their opposing longitudinal ends 23. A middle portion 24 of the diaphragm springs 21, 22 is connected to the frame of the compressor, in the case of the rear diaphragm spring 21 by spacer blocks 25, the extent of which determines the maximum possible stroke of the oscillating body 16, and in the case of the front plate spring 22 by two punched or drilled openings, through which there extends in each case a suction or pressure connecting pipe 26 or 27 of the pump chamber 13. The form-fitting engagement of the connecting pipes 26, 27 in the openings in the diaphragm spring 22 simplifies assembly of the compressor, since it makes superfluous captive fixing of the diaphragm spring 22 to the frame by welding, riveting or screw connection or the like. The diaphragm springs 21, 22 are biased slightly towards one another, such that their end areas in each case rest without play against one flank of the slots accommodating them in the housing, even if the slots in the housing are wider than the thickness of the diaphragm spring: rattling caused by temporary loss of contact between the diaphragm springs 21, 22 and said flanks of the slots or between the pump chamber 13 and the diaphragm spring 22 is therefore ruled out.

Instead of the connecting pipes 26, 27 passing through the openings in the diaphragm springs 22, a connection could also be provided between the latter and the pump chamber 13 by engagement of a projection, in principle of any desired shape, of the plate spring 22 or of the pump chamber 13 into a complementarily shaped recess in the pump chamber 13 or the plate spring 22 respectively or a bond could be provided, for example by spot welding.

The invention claimed is:

1. A linear compressor comprising:

a rigid frame;

an oscillating body being mounted on the frame with at least one spring so as to be able to effect reciprocating motion;

an electromagnet mounted for driving the reciprocating motion of the oscillating body;

a pump chamber forming part of the frame;

a piston at least partially disposed within the pump chamber and connected to the oscillating body and providing a reciprocating motion, wherein the at least one spring includes a diaphragm spring having a zigzag-spring arm and wherein the frame is connected in an oscillatory manner to a fixing member and fixes the linear compressor to a support by the diaphragm spring oriented transversely of the direction of movement of the oscillating body.

2. The linear compressor as claimed in claim 1, wherein two opposing end portions of the diaphragm spring are fixed to the fixing member and an intermediate portion is fixed to the frame.

3. The linear compressor as claimed in claim 1, wherein a center of gravity of the oscillating body and a center of gravity of the frame lie on one and the same line extending in the direction of movement of the oscillating body.

4. The linear compressor as claimed in claim 1, wherein the fixing member is a housing surrounding the pump chamber and the frame.

5. The linear compressor as claimed in claim 1, wherein the zigzag-curved spring arm connects the frame to the fixing member.

6. The linear compressor as claimed in claim 1, wherein the diaphragm spring is a one-piece spring, which includes a portion connecting the oscillating body to the frame.

7. The linear compressor as claimed in claim 6, wherein the diaphragm spring is connected to the oscillating body in a middle portion, connected to the fixing member in two end portions, and connected to the frame at portions located in each case between the middle portion and the end portions.

8. The linear compressor as claimed in claim 1, wherein the diaphragm spring connects the oscillating body to the frame.

9. The linear compressor as claimed in claim 1, wherein the diaphragm spring connecting the oscillating body to the frame comprises at least two curved arms connecting the frame to the oscillating body and mutually mirror-symmetrical relative to a plane parallel to the direction of movement of the oscillating body.

10. The linear compressor as claimed in claim 1, wherein a portion of the diaphragm spring is connected to the fixing member via at least one oscillation-damping element.

11. The linear compressor as claimed in claim 1, further comprising a second diaphragm spring connecting the frame to the fixing member, which second diaphragm spring is spaced from the first diaphragm spring in the direction of the reciprocating motion.

12. The linear compressor as claimed in claim 1, further comprising at least one pair of electromagnets arranged anti-parallel and with a field axis oriented in the direction of movement of the oscillating body on opposing sides of the oscillating body.

13. The linear compressor as claimed in claim 1, wherein the diaphragm spring comprises two zigzag-spring arms that connect the frame to the oscillating body and that are mutually mirror-symmetrical relative to a plane parallel to the direction of movement of the oscillating body.

14. The linear compressor as claimed in claim 1, wherein the diaphragm spring comprises a plurality of zigzag-spring arms each connecting the frame to the oscillating body, the plurality of zigzag-spring arms being mutually mirror-symmetrical relative to a plane parallel to the direction of movement of the oscillating body.

15. The linear compressor as claimed in claim 14, wherein two zigzag spring arms of the plurality of zigzag-spring arms are disposed on each side of the plane parallel to the direction of movement of the oscillating body.

16. The linear compressor as claimed in claim 1, wherein the diaphragm spring comprises:

a middle portion connecting the diaphragm spring to the oscillating body; and a plurality of zigzag-spring arms having a first end and a second end, each of the plurality of zigzag-spring arms connected to the middle portion at the first end and connected to the frame at the second end.

17. The linear compressor as claimed in claim 16, wherein each of the plurality of zigzag-spring arms includes a plurality of straight portions.

18. The linear compressor as claimed in claim 16, wherein each of the plurality of zigzag-spring arms includes a plurality of parallel straight portions.

19. The linear compressor as claimed in claim 16, wherein each of the plurality of zigzag-spring arms includes three parallel straight portions.

20. The linear compressor as claimed in claim 16, wherein two zigzag spring arms of the plurality of zigzag-spring arms are disposed on each side of a plane parallel to the direction of movement of the oscillating body.

21. The linear compressor as claimed in claim 20, wherein the diaphragm spring further comprises:

an intermediate portion that connects the second end of each of the two zigzag spring arms of the plurality of zigzag-spring arms that are disposed on a same side of the plane parallel to the direction of movement of the oscillating body.

22. The linear compressor as claimed in claim 16, wherein the diaphragm spring further comprises:

an end spring arm having a first end and a second end, wherein the first end of the end spring arm is connected to the fixing member and the second end of the end spring arm is connected to the second end of one of the plurality of zigzag-spring arms.

23. The linear compressor as claimed in claim 22, wherein two zigzag spring arms of the plurality of zigzag-spring arms are disposed on each side of a plane parallel to the direction of movement of the oscillating body.

24. The linear compressor as claimed in claim 23, wherein the diaphragm spring further comprises:

an intermediate portion that connects the second end of each of the two zigzag spring arms of the plurality of zigzag-spring arms that are disposed on a same side of the plane parallel to the direction of movement of the oscillating body.

25. The linear compressor as claimed in claim 22, wherein the end spring arm includes a plurality of parallel straight portions.

26. The linear compressor as claimed in claim 22, wherein the end spring arm includes two parallel straight portions.

27. The linear compressor as claimed in claim 1, wherein the diaphragm spring further comprises:

a middle portion connecting the diaphragm spring to the oscillating body;

a plurality of zigzag-spring arms having a first end and a second end, each of the plurality of zigzag-spring arms connected to the middle portion at the first end and connected to the frame at the second end;

an intermediate portion that connects the second end of a pair of spring arms of the plurality of zigzag-spring arms; and an end spring arm at each longitudinal end of the diaphragm spring, the end spring arm having a first end and a second end, wherein the first end of the end spring arm is connected to the fixing member and the second end of the end spring arm is connected to the second end of one of the plurality of zigzag-spring arms.

28. The linear compressor as claimed in claim 1, wherein the diaphragm spring is connected to the oscillating body at a first connection point of the diaphragm spring, to the frame at a second connection point of the diaphragm spring, and to the fixing member at a third connection point of the diaphragm spring.

* * * * *